US006270591B2

(12) United States Patent
Chiriac et al.

(10) Patent No.: US 6,270,591 B2
(45) Date of Patent: Aug. 7, 2001

(54) AMORPHOUS AND NANOCRYSTALLINE GLASS-COVERED WIRES

(76) Inventors: Horia Chiriac, Str. Al. Vlahuta 7B, etaj 2, ap. 9; Firuta Barariu, Str. Closca 8-C2, etaj 7, ap. 27, both of 6600 Iasi; Adrian Tibor Ovari, Calea Marasesti 17-B7, sc. A, etaj 3, ap. 16 5800, Suceava; Gheorghe Pop, Str. A. Panu 56-B1, etaj 1, ap. 3 6600, Iasi, all of (RO)

( * ) Notice: Subject to any disclaimer, the term of this patent is extended or adjusted under 35 U.S.C. 154(b) by 0 days.

(21) Appl. No.: 09/101,006

(22) PCT Filed: Nov. 12, 1996

(86) PCT No.: PCT/RO96/00009

§ 371 Date: Jun. 25, 1998

§ 102(e) Date: Jun. 25, 1998

(87) PCT Pub. No.: WO97/24734

PCT Pub. Date: Jul. 10, 1997

(30) Foreign Application Priority Data

Dec. 27, 1995 (RO) ..... 95-02277

(51) Int. Cl.[7] ..... H01F 1/04

(52) U.S. Cl. ..... 148/300; 148/301; 148/302; 148/303; 148/304; 428/379

(58) Field of Search ..... 428/379; 75/952; 148/300, 301, 302, 304

(56) References Cited

U.S. PATENT DOCUMENTS

| | | | | |
|---|---|---|---|---|
| 4,482,400 | | 11/1984 | O'Handley | 148/31.55 |
| 5,635,828 | * | 6/1997 | Yoshizawa et al. | 323/362 |
| 5,966,064 | * | 10/1999 | Yoshizawa et al. | 336/221 |

OTHER PUBLICATIONS

Mitra et al. "Stress– and Annealing–Dependent Magnetic Properties of Amorphous Wires." Journal of Physics D: Applied Physics. vol. 23, pp. 228–233, 1990.*

Magnetic Anisotropy in FeSiB Amorphous Glass–covered Wires by H. Chiriac et al., *IEEE Transactions on Magnetics,* vol. 32 No. 5, Sep. 1996, pp. 4755–4757.

Magnetic Behavior of Glass–Covered Amorphous wires by H. Chiriac et al. in *Journal of Magnetic Materials* No. 157/158 (1996) pp. 227–228.

Internal Stresses in Highly Magnetostrictive Glass–Covered Amorphous Wires, by H. Chiriac et al. in *Journal of Magnetism and Magnetic Materials* No. 160 (1996) pp. 237–238.

Magnetization Processes in Amorphous FeSiB Glass Covered Wires by H. Chiriac et al. in *Journal of Non–Crystalline Solids* No. 205–207 (1996) pp. 687–691.

Magnetic Behavior of Negative and Nearly Zero Magnetostrictive Glass–Covered Amorphous Wires by H. Chiriac et al. in *IEEE Transactions on Magnetics,* vol. 32 No. 5 Sep. 1996, pp. 4872–4874.

*Journal of Applied Physics,* vol. 75, No. 10, Part 02B, May 15, 1994, NY, pp. 6949–6951, XP000458267, Chiriac et al. "Magnetic Behavior of the Amorphous Wires Covered by Glass".

*Journal of Magnetism and Magnetic Materials,* vol. 140/144, No. Part 03, Feb. 1, 1995, pp. 1903–1904, XP000941082, Exhavarrieta et al. "Effects of Tensile Stress on the Domain Wall Dynamics of Co–based Amorphous Ferromagnetic Wires".

*Journal of Magnetism and Magnetic Materials,* vol. 151, No. 1/02, Nov. 2, 1995, pp. 132–138, XP000541509, Zhukov et al. "The Remagnetisation Process in Thin and Ultra–Thin Fe–Rich Amorphous Wires".

*Physical Review, Condensed Matter,* vol. 52, No. 14 Part 02, Oct. 1, 1995, pp. 10104–10113, XP000545829, Chiriac et al. "Internal Stress Distribution in Glass–Covered Amorphous . . . ".

*IEEE Transactions on Magnetics,* vol. 29, No. 6, Nov. 1, 1993, pp. 2673–2675, XP000432294, Gomez–Polo et al. "The Influence of Manocrystalline Microstructure on the Magnetic Properties of . . . ".

*IEEE Transactions on Magnetics,* vol. 29, No. 6, Nov. 1, 1993, pp. 3475–3477, XP000429386, Aragoneses et al., "Influence of the Thermal Treatments and Mechanical Stress on the Magnetic . . . ".

*Journal of Materials Science,* vol. 20, 1985, London GB, pp. 1883–1888, XP000616185, T. Goto et al. "The Preparation of Ductile High Strength Fe–Based Filaments Using the Methods . . . ".

*Patent Abstracts of Japan* vol. 95, No. 006 & JP 07 153639A (NHK Spring Co Ltd), Jun. 16, 1995.

* cited by examiner

*Primary Examiner*—Roy King
*Assistant Examiner*—Tima McGuthry-Banks
(74) *Attorney, Agent, or Firm*—Horst M. Kasper

(57) ABSTRACT

The invention refers to amorphous and nanocrystalline magnetic glass-covered wires. The wires consist of a metallic amorphous or nanocrystalline core with diameters by the order of $10^{-6}$ m, having compositions based on transition metal-metalloids and other additional metals and a glass cover, having a thickness of the wall by the same order of magnitude. The wires present high or medium saturation inducation, positive, negative or nearly zero magnetostriction and values of the coercive field and of the magnetic permeability in function of the requested applications in a field of electronics and electrotechnics to achieve sensors, transducers, inductive coils, trnasformers, magnetic shields, devices working on the basis of the correlation between the magnetic properties of the metallic core and the optical properties of the glass cover.

5 Claims, No Drawings

AMORPHOUS AND NANOCRYSTALLINE GLASS-COVERED WIRES

TECHNICAL FIELD

The invention refers to amorphous and nanocrystalline magnetic glass-covered wires with applications in electrotechnics and electronics and to a process for their production.

BACKGROUND ART

There are known ribbon and wire shaped amorphous magnetic materials obtained by rapid quenching from the melt and nanocrystalline magnetic materials obtained by thermal treatment of amorphous ones with adequate compositions (U.S. Pat. No. 4,501,316/Feb. 26, 1985 and U.S. Pat. No. 4,523,626/Jun. 18, 1985). Thus, amorphous magnetic wires with diameters ranging from 60 $\mu$m . . . 180 $\mu$m are obtained by the in-rotating-water spinning method and nanocrystalline magnetic wires are obtained by controlled thermal treatments of the above mentioned amorphous ones with adequate compositions. The disadvantage of these wires consists in the fact that they can not be obtained directly from the melt in amorphous state with diameters less than 60 $\mu$m. Amorphous magnetic wires having diameters of minimum 30 $\mu$m are obtained by successive cold-drawings of the above mentioned amorphous magnetic wires followed by stress relief thermal treatments. The disadvantage of these wires consists in the fact that by repeated drawings and annealing stages they can be obtained amorphous magnetic wires having no less than 30 $\mu$m in diameter and also in the fact that their magnetic and mechanical properties are unfavorably affected by the mechanical treatments.

There are also known metallic glass-covered wires in crystalline state as well as some glass-covered amorphous alloys obtained by the glass-coated melt spinning method (T. Goto, T. Toyama, "The preparation of ductile high strength Fe-base filaments using the methods of glass-coated melt spinning", *Journal of Materials Science* 20(1985) pp. 1883–1888). The disadvantage of these wires consists in the fact that they do not present appropriate magnetic properties and behavior for applications in electronics and electrotechnics to achieve magnetic sensors and actuators, but only properties that makes them useful as metallic catalysts, composite materials, electrical conductors.

There are known amorphous magnetic glass-covered wires having the compositions $Fe_{65}B_{15}Si_{15}C_{15}$, $Fe_{60}B_{15}Si_{15}Cr_{10}$ and $Fe_{40}Ni_{40}P_{14}B_6$ (H. Chiriac et al., "Magnetic behavior of the amorphous wires covered by glass", *Journal of Applied Physics* 75 (10), (1994), pp. 6949–6951) with diameters of the metallic core ranging between 5 and 30 $\mu$m, coercive fields between 239 and 462 A/m, and magnetization between 0.16 to 0.32T. It is also mentioned a method for their obtaining based on the Taylor method, indicating as steps: the sealing of the glass tube, the heating of the seal and the drawing of a fibre from the heated end.

There are also known amorphous glass-covered wires of compositions $(Fe_{80}Co_{20})_{75}B_{15}Si_{10}$ and $Fe_{65}B_{15}Si_{15}C_{15}$ like in the above mentioned in Prior Art (A. P. Zhukov et al., "The remagnetization process in thin and ultra-thin Fe-rich amorphous wires", *JMMM* 15(1995), pp. 132–138) having diameters of the metallic core of 10 and 15 $\mu$m respectively, thickness of the glass-cover of 2.5 $\mu$m, and coercive fields of 65 and 140 A/m respectively.

DISCLOSURE OF INVENTION

Technical problem resolved by this invention consists in the obtaining, directly by rapid quenching from the melt, of the glass-covered magnetic amorphous wires having controlled dimensional and compositional characteristics and in the obtaining, by thermal treatments, of the nanocrystalline magnetic wires with adequate magnetic properties for different applications categories.

The amorphous magnetic wires, according to the invention, are characterized in the fact that they consist in an amorphous metallic inner core with diameters ranging between 1 $\mu$m and 50 $\mu$m and a glass cover in the shape of a glass coat with a thickness ranging between 0.5 $\mu$m and 20 $\mu$m, the metallic core having compositions chosen so to allow to obtain wires in amorphous state, at cooling rates that can be technically obtained and with adequate magnetic properties for different applications categories. The amorphous magnetic wires, according to the invention, consists of an amorphous metallic inner core of compositions based on transition metals (Fe, Co, and/or Ni) 60 . . . 80 atomic %, 40 . . . 15 atomic % metalloid (B, Si, C and/or P) as well as 25 atomic % or less additional metals such as Cr, Ta, Nb, V, Cu, Al, Mo, Mn, W, Zr, Hf, having diameters ranging between 1 and 50 $\mu$m and a glass cover with thickness ranging between 0.5 and 20 $\mu$m. The amount of the transition metals and metalloids is chosen so to obtain alloys with high saturation magnetization, positive, negative or nearly zero magnetostriction, coercive field and magnetic permeability having adequate values in function of the requested applications. The total amount and the number of the additional elements are chosen so to facilitate the amorphism-forming ability.

For applications in sensors and transducers in which a rapid variation of the magnetization as function of external factors (magnetic field, tensile stress, torsion) is required, they are adequate amorphous magnetic glass-covered wires, according to the invention, having high positive magnetostriction, 5 up to 25 $\mu$m diameter of the metallic core and 1 up to 15 $\mu$m thickness of the glass cover, of compositions based on Fe containing 20 atomic % or less Si, 7 up to 35 atomic % B and 25 atomic % or less from one or more metals selected from the group Co, Ni, Cr, Ta, Nb, V, Cu, Al, Mo, Mn, W, Zr, Hf.

For applications in sensors and transducers that require a variation of the magnetization as function of external factors (magnetic field, tensile stress, torsion), whose value must be controlled with a high sensitivity, as well as for applications based on the giant magneto-impedance effect involving high values of the magnetic permeability and reduced values of the coercive field, they are adequate amorphous magnetic glass-covered wires, according to the invention, having negative or almost zero magnetostriction, with diameters of the metallic core ranging between 5 and 25 $\mu$m and thickness of the glass cover ranging between 1 and 15 $\mu$m of compositions based on Co containing 20 atomic % or less Si, 7 up to 35 atomic % B and 25 atomic % or less from one or more metals selected from the group Fe, Ni, Cr, Ta, Nb, V, Cu, Al, Mo, Mn, W, Zr, Hf.

For applications as minitransformers and inductive coils, that implies high values of the saturation magnetization and of the magnetic permeability they are adequate nanocrystalline magnetic glass-covered wires according to the invention with diameters of the metallic core ranging between 5 and 25 $\mu$m and thickness of the glass cover ranging between 1 and 15 $\mu$m of compositions based on Fe containing 20 atomic % or less is, 7 up to 35 atomic % B and 25 atomic % or less from one or more metals selected from the group Cu, Nb, V, Ta, W, Zr, Hf.

For applications in devices working on the base of the correlation between the magnetic properties of the amorphous metallic core with positive or nearly zero magnetostriction or of the nanocrystalline metallic core having nearly zero magnetostriction and the optical properties of the glass cover, properties that are related to the optical transmission of the information, they are adequate amorphous and nanocrystalline glass-covered wires according to the invention, with diameters of the metallic core ranging between 10 and 20 $\mu$m and thickness of the glass cover ranging between 10 and 20 $\mu$m of compositions based on Fe or Co containing 20 atomic % or less is, 7 up to 35 atomic % B and 25 atomic % or less from one or more metals selected from the group Ni, Cr, Ta, Nb, V, Cu, Al, Mo, Mn, W, Zr, Hf.

The process of producing amorphous magnetic glass-covered wires, according to the invention, allows to obtain wires with the above mentioned dimensional and compositional characteristics directly by rapid quenching from the melt and consists in melting the metallic alloy which is introduced in a glass tube till the glass becomes soft, drawing the glass tube together with the molten alloy which is stretched to form a glass-coated metallic filament which is coiled on a winding drum ensuring a high cooling rate necessary to obtain the metallic wire in amorphous state in the following conditions:

- the temperature of the molten metal ranging between 900° C. and 1500° C.;
- the diameter of the glass tube ranging between 3 and 15 mm and the thickness of the glass wall ranging between 0.1 and 2 mm;
- the glass tube, containing the molten alloy, moves down with a uniform feed-in speed ranging between $5\times10^{-6}$ and $170\times10^{-6}$ m/s;
- the vacuum or the inert gas atmosphere level in the glass tube, above the molten alloy, ranging between 50 and 200 N/m$^2$;
- the drawing speed of the wire ranging between 0.5 and 10 m/s;
- the flow capacity of the cooling liquid through which the wire passes ranging between $10^{-5}$ and $2\times10^{-5}$ m$^3$/s.

To ensure the continuity of the process and also to obtain continuous glass-covered wires of good quality and having the requested dimensions it is necessary that the employed materials and the process parameters to fulfill the following conditions:

- the high purity alloy is prepared in an arc furnace or in an induction furnace using pure components (at least 99% purity) bulk shaped or powders bond together by pressing and than heating in vacuum or inert atmosphere (depending on the reactivity of the employed components);
- during the glass-coated melt spinning process an inert gas is introduced in the glass tube to avoid the oxidation of the alloy;
- the employed glass must be compatible with the metal or the alloy at the drawing temperature in order to avoid the process of glass-metal diffusion;
- the thermal expansion coefficient of the glass must be equal or slightly smaller than that of the employed metal or alloy to avoid the fragmentation of the alloy during the solidification process due to the internal stresses.

By performing special heat treatments of the glass-covered amorphous magnetic wires having compositions which are adequate to obtain the nanocrystalline state, in an electric furnace, in vacuum or in inert atmosphere, at annealing temperatures smaller than the crystallization temperature of the amorphous alloy, the values ranging between 480° C. and 550° C. for a given period of time ranging between 10 seconds and $10^5$ seconds one obtains magnetic glass-covered wires having a nanocrystalline structure, almost zero magnetostriction and high values of the saturation magnetization and magnetic permeability.

The advantages of the wires, according to the invention consist in the following:

- they can be used into a large field of applications based on their magnetic properties and behavior;
- they present the switching of the magnetization (large Barkhausen effect) for very short length, down to 1 mm, as compared to the amorphous magnetic wires obtained by the in-rotating-water spinning method that present the switching of the magnetization for lengths of minimum 5–7 cm or to the cold-drawn ones that present this effect for lengths of minimum 3 cm; in this way they permit the miniaturization of the devices in which they are used;
- they can be used in devices based on the correlation between the magnetic properties of the metallic core and the optical properties of the glass cover, this application being facilitated by the intimate contact between the metallic core and the glass cover;
- they can be used in devices which involve suitable magnetic properties of the metallic core together with corrosion resistance, and the electrical insulation offered by the glass cover.

The advantages of the producing process, according to the invention, are as follows:

- allow the achievement of nanocrystalline magnetic materials in the shape of glass-covered wires having very small diameters;
- allow to obtain at low costs amorphous and nanocrystalline magnetic glass-covered wires having very small diameters of the magnetic core.

BEST MODE FOR CARRYING OUT THE INVENTION

In order to more completely understand the present invention, the following 6 examples are presented:

EXAMPLE 1

A quantity of 100 g $Fe_{77}B_{15}Si_8$ alloy is prepared by induction melting in vacuum pure components in the shape of powders bond together by pressing and heating in vacuum. About 10 g of the as prepared alloy are introduced in a Pyrex® tube, closed at the bottom end, having 12 mm external diameter, 0.8 mm thickness of the glass wall and 60 cm in length. The upper end of the tube is connected at a vacuum device which provide a vacuum of $10^4$ N/m$^2$ and allow to introduce an inert gas at a pressure level of 100 N/m$^2$. The bottom end of the tube which contains the alloy is placed into an induction coil in the shape of a single spiral of a certain profile which is feed by a medium frequency generator. The metal is induction heated up to the melting point and overheated up to 1200±50° C. At this temperature, at which the glass tube becomes soft, a glass capillary in which a metallic core is entrapped is drawn and winded on a winding drum. Maintaining constant values of the process parameters: $70\times10^{-6}$ m/s feed-in speed of the glass tube, 1.2 m/s peripheral speed of the winding drum, and $15\times10^{-6}$ m$^3$/s flow capacity of the cooling liquid one obtains a high positive magnetostrictive glass-covered amorphous wire of composition $Fe_{77}Bi_{15}Si_8$, having 15 μm diameter of the metallic core, 7 μm thickness of the glass cover, that present the following magnetic characteristics:

large Barkhausen jump ($M_r/M_s$=0.96);

high saturation induction ($B_s$=1.6 T);

high positive saturation magnetostriction ($\lambda_s=+35\times10^{-6}$);

switching field (H*=67 A/m).

These wires are used for sensors measuring torque, magnetic field, current, force, displacement etc.

EXAMPLE 2

A glass-covered wire was produced in the same manner as in Example 1, using an alloy of composition $Co_{40}Fe_{40}B_{12}Si_8$ which was prepared in vacuum from bulk pure components. The glass tube has 10 mm external diameter, 1 mm thickness of the glass wall and 50 cm in length. In the glass tube they are introduced and melted 5 g of the mentioned alloy, the melt temperature being 1250±50° C. The process parameters are maintained at constant values of: $5\times10^{-6}$ m/s feed-in speed of the glass tube, 0.5 m/s peripheral speed of the winding drum, and $20\times10^{-6}$ $m^3$/s flow capacity of the cooling liquid. The resulted positive magnetostrictive amorphous magnetic glass-covered wire of composition $Co_{40}Fe_{40}B_{12}Si_8$ having 25 μm diameter of the metallic core and 1 μm thickness of the glass cover present the following magnetic characteristics:

large Barkhausen jump ($M_r/M_s$=0.70);

high saturation induction ($B_s$=1.4 T);

medium positive saturation magnetostriction ($\lambda_s=+23\times10^{-6}$);

switching field (H*=1500 A/m).

These wires are used for magnetic sensors, transducers, and actuators measuring mechanical quantities.

EXAMPLE 3

A glass-covered wire was produced in the same manner as in Example 1, using an alloy of composition $Co_{75}B_{15}Si_{10}$. The glass tube has 10 mm external diameter, 0.9 mm thickness of the glass wall and 55 cm in length. In the glass tube they are introduced and melted 5 g of the mentioned alloy, the melt temperature being 1225±50° C. The process parameters are maintained at constant values of: $100\times10^{-6}$ m/s feed-in speed of the glass tube, 8 m/s peripheral speed of the winding drum, and $12\times10^{-6}$ $m^3$/s flow capacity of the cooling liquid. The resulted negative magnetostrictive amorphous magnetic glass-covered wire of composition $Co_{75}B_{15}Si_{10}$ having 5 μm diameter of the metallic core and 6.5 μm thickness of the glass cover present the following magnetic characteristics:

does not present large Barkhausen jump;

small saturation inducation ($B_s$=0.72 T);

small negative saturation magnetostriction ($\lambda_s=-3\times10^{-6}$).

These wires are used for magneto-inductive sensors measuring magnetic fields of small values.

EXAMPLE 4

A glass-covered wire was produced in the same manner as in Example 1, using an alloy of composition $Co_{70}Fe_5B_{15}Si_{10}$. The glass tube has 11 mm external diameter, 0.8 mm thickness of the glass wall and 45 cm in length. In the glass tube they are introduced and melted 12 g of the mentioned alloy, the melt temperature being 1200±50° C. The process parameters are maintained at constant values of: $50\times10^{-6}$ m/s feed-in speed of the glass tube, 2 m/s peripheral speed of the winding drum, and $17\times10^{-6}$ $m^3$/s flow capacity of the cooling liquid. The resulted amorphous magnetic glass-covered wire of composition $Co_{70}Fe_5B_{15}Si_{10}$ having nearly zero magnetostriction, 16 μm diameter of the metallic core and 5 μm thickness of the glass cover present the following magnetic characteristics:

does not present large Barkhausen jump;

small saturation inducation ($B_s$=0.81 T);

almost zero saturation magnetostriction ($\lambda_s=-0.1\times10^{-6}$);

high relative magnetic permeability ($\mu_r$=10 000).

These wires are used for magnetic field sensors, transducers, magnetic shields and devices operating on the basis of the giant magneto-impedance effect.

EXAMPLE 5

A glass-covered wire as produced in the same manner as in Example 1, using an alloy of composition $Fe_{73.5}Cu_1Nb_3B_9Si_{13.5}$ prepared in argon atmosphere from pure components in the shape of powders bond by pressing and heating in vacuum. The glass tube has 10 mm external diameter, 0.6 mm thickness of the glass wall and 50 cm in length. In the glass tube they are introduced and melted 10 g of the mentioned alloy, the melt temperature being 1200±50° C. The process parameters are maintained at constant values of: $6.5\times10^{-6}$ m/s feed-in speed of the glass tube, 0.8 m/s peripheral speed of the winding drum, and $18\times10^{-6}$ $m^3$/s flow capacity of the cooling liquid. The resulted positive magnetostrictive amorphous magnetic glass-covered wire of composition $Fe_{73.5}Cu_1Nb_3B_9Si_{13.5}$ having 22 μm diameter of the metallic core and 4 μm thickness of the glass cover present the following magnetic characteristics:

large Barkhausen jump ($M_r/M_s$=0.80);

saturation inducation ($B_s$=1.11T);

positive saturation magnetostriction ($\lambda_s=+4\times10^{-6}$);

switching field (H*=137 A/m).

These wires are used for magnetic sensors measuring mechanical quantities and also as precursors for nanocrystalline glass-covered wires.

EXAMPLE 6

A special thermal treatment is applied to an amorphous magnetic wire of compositions $Fe_{73.5}Cu_1Nb_3B_9Si_{13.5}$ obtained in the same manner as in Example 5. The special character of the thermal treatment refers to the strict correlation between the temperature and the duration of the thermal treatment. The magnetic amorphous glass-covered wire having the above mentioned composition is introduced into an electric furnace, in argon atmosphere and is thermally treated at 550° C. for 1 hour. In this way one obtains a magnetic glass-covered wire having nanocrystalline structure that present the following magnetic characteristics:

does not present large Barkhausen jump ($M_r/M_s$=0.2);

saturation inducation ($B_s$=1.25 T);

almost zero saturation magnetostriction ($\lambda_s=-0.1\times10^{-6}$);

These wires are used in inductive coils, mini-transformers, and magnetic shields.

The magnetic measurements were performed using a fluxmetric method and the amorphous state was checked by X-ray diffraction.

What is claimed is:

1. Amorphous magnetic glass-covered wires characterized in the fact that they consist of a metallic amorphous core with diameters ranging between 5 and 25 $\mu$m of compositions containing 67 to 80 atomic % Fe,13 atomic % or less Si, 7 up to 35 atomic % B and 25 atomic % or less of one or more metals selected from the group consisting of Co, Ni, Cr, Ta, Nb, V, Cu, Al, Mo, Mn, W, Zr and Hf and a glass cover with the thickness ranging between 1 and 15 $\mu$m, having 0.7 up to 1.6 T saturation inducation, positive magnetostriction ranging between $+40\times10^{-6}$ and $+5\times10^{-6}$, coercive field from 40 to up to 4500 A/m.

2. Amorphous magnetic glass-covered wires, characterized in the fact that they consist of a metallic amorphous core with diameters ranging between 5 and 25 $\mu$m of compositions containing 60 to 80 atomic % Co,20 atomic % or less Si, 7 up to 35 atomic % B and 25 atomic % or less or one or more metals selected from the group consisting of Fe, Ni, Cr, Ta, Nb, V, Cu, Al, Mo, Mn, W, Zr and Hf and a glass cover with the thickness ranging between 1 and 15 $\mu$m, having 0.6 up to 0.85 T saturation magnetization, negative or nearly zero magnetostriction ranging between $-6\times10^{-6}$ and $-0.1\times10^{-6}$, coercive field from 20 up to 500 A/m, and relative magnetic permeability ranging between 100 and 12000.

3. Amorphous magnetic glass-covered wires, that can be used for the achievement of devices operating on the basis of the correlation between the magnetic properties of the amorphous magnetic inner core and the optical properties of the glass cover, characterized in the fact that they consist of a metallic amorphous core with diameters ranging between 10 and 22 $\mu$m of compositions containing 67 to 74 or 76 to 80 atomic % Fe and Co, 13 atomic % or less Si, 7 up to 35 atomic % B and 25 atomic % or less of one or more metals selected from the group consisting of Ni, Cr, Ta, Nb, V, Cu, Al, Mo, Mn, W, Zr, Hf and a glass cover with the thickness ranging between 10 and 20 $\mu$m, having 0.7 up to 1.6 T saturation induction, positive magnetostriction ranging between $+40\times10^{-6}$ and $+6\times10^{-6}$, coercive field ranging between 40 and 4500 A/m or with negative or nearly zero magnetostriction ranging between $-6\times10^{-6}$ and $-0.1\times10^{-6}$, coercive field ranging between 20 and 1000 A/m, and relative magnetic permeability ranging between 100 and 12000.

4. Nanocrystalline magnetic wires characterized in the fact that they consist of a metallic core with diameters ranging between 5 and 25 $\mu$m and a glass cover with the thickness ranging between 1 and 15 $\mu$m the nanocrystalline magnetic wires having compositions consisting of an alloy based on Fe containing 20 atomic % or less Si, 7 up to 35 atomic % B and 25 atomic % or less of one or more metals selected from the group consisting of Co, Ta, Nb, V, Cu, W, Zr and Hf, having saturation inducation ranging between 0.7 and 1.25 T, almost zero magnetostriction, coercive field between 20 and 2500 A/m and relative magnetic permeability ranging between 100 and 12000.

5. Amorphous magnetic glass-covered wires consist of a metallic amorphous core with diameters ranging between 1 and 50 $\mu$m of compositions base don 67 to 78 atomic % transition metals selected from the group consisting of Fe, Co, and/or N, 40 to 15 atomic % metalloid selected from the group consisting of B, Si, C, and/or P as well as 25 atomic % or less additional metals selected from Cr, Ta, Nb, V, Cu, Al, Mo, Mn, W, Zr, and/or Hf, having 0.4 up to 1.6 T saturation inducation, positive, negative or nearly zero magnetostriction ranging between $+40\times10^{-6}$ and $-6\times10^{-6}$, coercive field ranging between 20 and 6000 A/m and relative magnetic permeability ranging between 100 and 12,000 and a glass cover with thickness ranging between 0.5 and 20 $\mu$m.

* * * * *

UNITED STATES PATENT AND TRADEMARK OFFICE

CERTIFICATE OF CORRECTION

PATENT NO. : 6,270,591 B1
DATED : August 7, 2001
INVENTOR(S) : Chiriac et al.

It is certified that error appears in the above-identified patent and that said Letters Patent is hereby corrected as shown below:

Title page,
Item [57], ABSTRACT,
Line 8, delete "inducation" and insert -- induction --
Line 12, delete "trnasformers" and insert -- transformers --

Column 2,
Line 63, delete "is" and insert -- Si --

Column 3,
Line 10, delete "is" and insert -- Si --

Column 5,
Line 54, delete "inducation" and insert -- induction --

Column 6,
Line 18, delete "as" and insert -- was --
Line 58, delete "inducation" and insert -- induction --

Column 7,
Line 6, delete "or" and insert -- of --
Line 9, delete "inducation" and insert -- induction --
Line 11, delete "Zr, Hf" and insert -- Zr and Hf --

UNITED STATES PATENT AND TRADEMARK OFFICE

CERTIFICATE OF CORRECTION

PATENT NO. : 6,270,591B1
DATED : August 7, 2001
INVENTOR(S) : Chiriac et al.

It is certified that error appears in the above-identified patent and that said Letters Patent is hereby corrected as shown below:

Column 8,
Line 1, after the word "wires" please insert -- characterized in that they --
Line 3, delete "don" and insert -- on --
Line 5, delete "N" and insert -- Ni --
Line 9, delete "inducation" and insert -- induction --

Signed and Sealed this

Seventh Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,270,591 B2
DATED : August 7, 2001
INVENTOR(S) : Chiriac et al.

It is certified that error appears in the above-identified patent and that said Letters Patent is hereby corrected as shown below:

Title page,
Insert -- Item [73] Assignee: Institutul de Fizica Tehnica
B-dul Mangeron No. 47
6600 Iasi, Romania --

Signed and Sealed this

Twenty-fourth Day of September, 2002

*Attest:*

*Attesting Officer*

JAMES E. ROGAN
*Director of the United States Patent and Trademark Office*